United States Patent [19]

Stephens

[11] Patent Number: 4,484,787

[45] Date of Patent: Nov. 27, 1984

[54] PORTABLE, FOLDABLE VOTING BOOTH/LECTERN

[75] Inventor: Richard J. Stephens, St. Charles, Ill.

[73] Assignee: Election Data Corporation, St. Charles, Ill.

[21] Appl. No.: 372,977

[22] Filed: Apr. 29, 1982

[51] Int. Cl.[3] ..... A47B 43/00

[52] U.S. Cl. ..... 312/239; 312/231; 312/233; 312/258; 312/259; 108/60

[58] Field of Search ..... 312/258, 259, 239, 196, 312/231, 233; 108/33, 60, 61; 206/491; 229/34 HW

[56] References Cited

U.S. PATENT DOCUMENTS

| | | | |
|---|---|---|---|
| 1,861,845 | 6/1932 | Dukes et al. | 312/259 |
| 2,808,305 | 10/1957 | Jackson | 312/258 |
| 3,026,996 | 3/1962 | Belsinger | 312/259 |
| 3,211,506 | 10/1965 | Levy et al. | 312/239 |
| 3,322,478 | 5/1967 | Brown | 312/239 |
| 3,333,766 | 8/1967 | Crossland et al. | 312/258 |
| 3,361,090 | 1/1968 | Howlett | 108/33 |
| 3,389,947 | 6/1968 | Kelley et al. | 312/258 |
| 3,429,632 | 2/1969 | Simon et al. | 312/259 |
| 3,455,255 | 7/1969 | Sanchez | 108/33 |
| 3,472,571 | 10/1969 | Himelreich | 312/259 |
| 3,531,170 | 9/1970 | Boyer | 312/259 |
| 3,544,184 | 12/1970 | Laws | 312/259 |
| 3,620,587 | 11/1971 | Ahmann | 312/258 |
| 3,630,588 | 12/1971 | Baker | 312/23 |

FOREIGN PATENT DOCUMENTS

| | | | |
|---|---|---|---|
| 687320 | 5/1964 | Canada | 312/259 |

*Primary Examiner*—Victor N. Sakran
*Attorney, Agent, or Firm*—Emrich & Dithmar

[57] ABSTRACT

A combination voting booth/speaker's lectern which is disposable, yet reusable is disclosed. The voting booth/-lectern includes an upper shelf member and a lower support member both preferably comprised of cardboard, or other commonly used, semi-rigid, lightweight and inexpensive material. The lower support member is foldable into three sections which are generally vertically oriented, the top portions of which are insertable into a series of slots on the lower side of the upper shelf member. The upper shelf member includes four foldable sections, one of which is positioned upon and engaged by the lower support section by means of the aforementioned slots. The remaining three sections of the upper shelf member may be folded upon one another in forming a speaker's lectern or may be extended to a generally vertical orientation so as to form a semi-enclosed area providing the privacy required when the present invention is used as a voting booth. The present invention is disposable, re-usable and portable while affording a stable, generally horizontal work or support surface which may be enclosed on three sides as desired.

1 Claim, 5 Drawing Figures

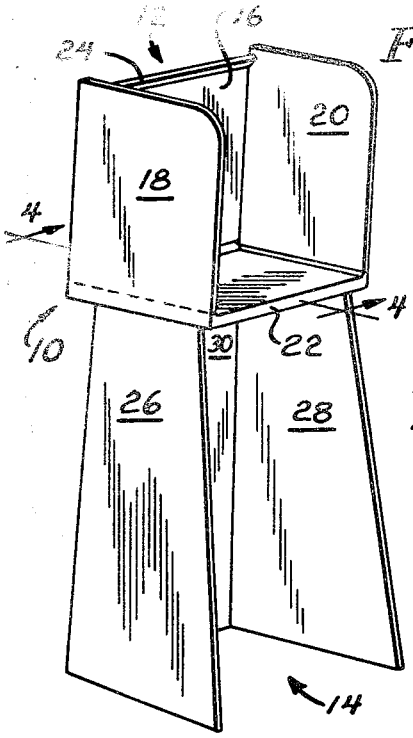
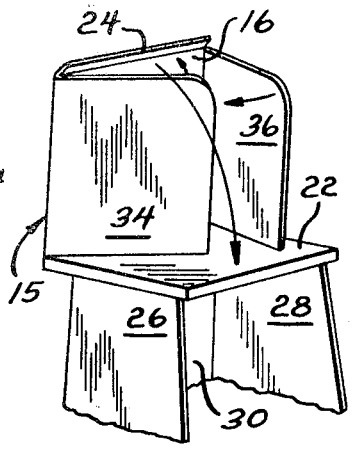
FIG. 3
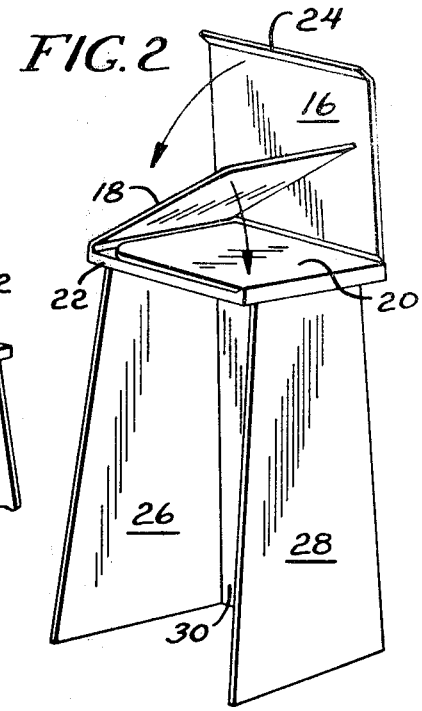
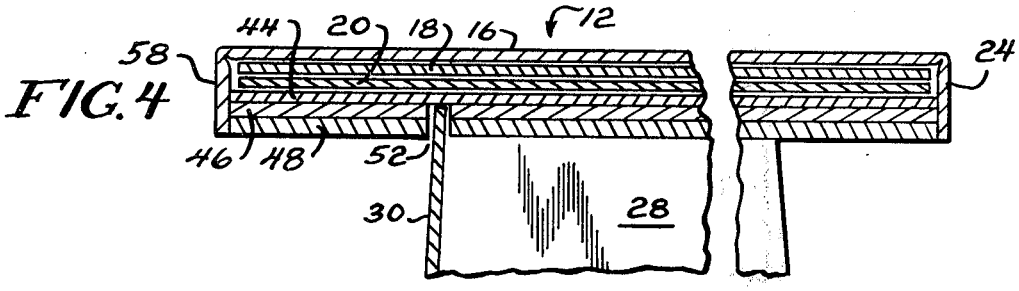
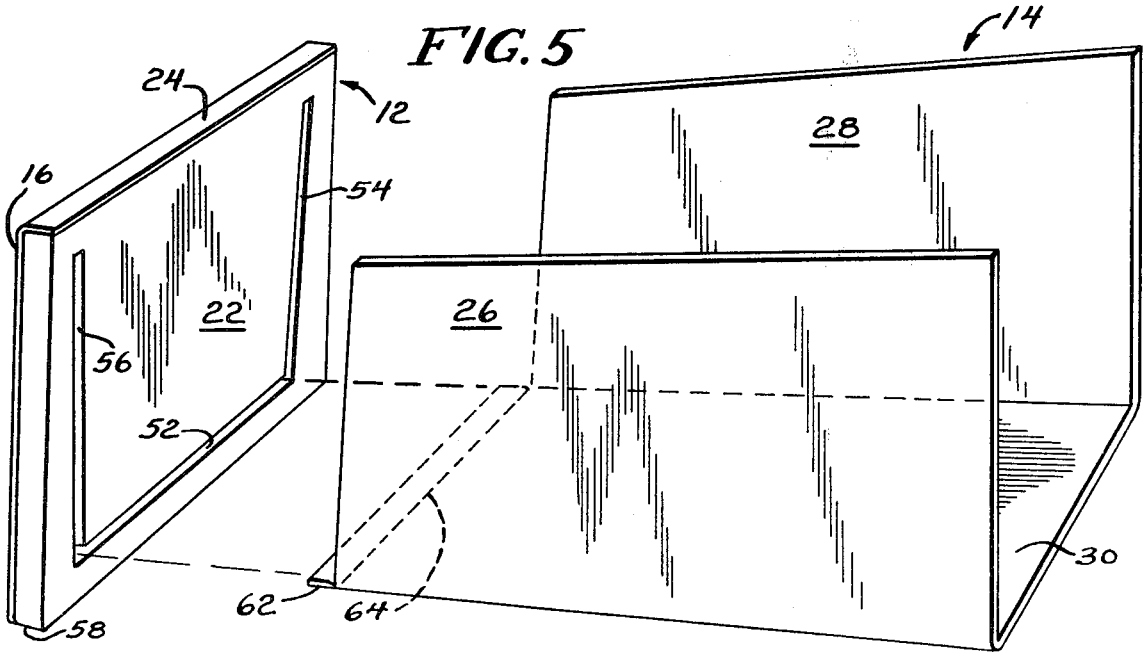

PORTABLE, FOLDABLE VOTING BOOTH/LECTERN

BACKGROUND OF THE INVENTION

This invention relates generally to podium-like structures for use by one in a standing position and more particularly is directed to a portable, disposable, yet re-usable combination lectern/voting booth.

Foldable types of voting booths are well known in the prior art and generally are comprised of an upper, lectern-like, enclosed structure affording privacy for the voter. Examples of this type of voting enclosure may be found in U.S. Pat. Nos. 3,333,766 to Crossland et al, 3,531,171 to Boyer, and 3,544,184 to Laws. These structures are collapsible and generally comprised of a bottom wall and a plurality of upstanding side walls foldably coupled to the bottom wall and to each other. Voting booths of this type generally require a supporting structure, such as a table, since no provision for the elevated use of this type of voting booth is typically provided.

In some voting booths provision is made for supporting the enclosed voting area by an attached or integrated support structure. An example of a voting booth of this type may be found in U.S. Pat. No. 3,389,947 to Kelley et al, wherein is described a foldable voting booth forming a plurality of separate compartments supported by a number of foldable legs. A similar structure is disclosed in U.S. Pat. No. 3,361,090 to Howlett which relates to a shielded desk having a top with a back panel and side shields with each shield having a fixed wing and a hinged side panel and box-type shelves which can be used in either of two positions. This desk structure includes foldable supporting legs and the entire structure may be folded into a compact, portable unit. U.S. Pat. No. 3,455,255 to Sanchez discloses a foldable supporting structure having a plurality of legs as used in the two aforementioned patents. The structures disclosed in the aforementioned patents are complicated, expensive and are somewhat heavy thus limiting their portability. Thus, these structures would have limited utility as voting booths in view of the infrequent use of such structures, the relative complexity in setting up and taking down these enclosures and their relative expense.

U.S. Pat. No. 3,322,478 to Brown discloses a voting booth comprised of corrugated cardboard material which may be folded along predetermined lines to form a three-sided structure into which the voter walks for casting his ballot. The cardboard structure includes a shelf supported from a pair of supporting columns all of which are integrally coupled to the three vertical partitions comprising the voting booth. This voting booth configuration virtually entirely encompasses the voter in providing more privacy than generally required in the typical polling place and thus represents an overly complicated and excessive use of structural materials.

The present invention is intended to overcome the aforementioned limitations in providing a simple, portable, disposable, yet re-usable, voting booth which affords adequate voter privacy, and which is easily converted into a conventional speaker's lectern for general use.

OBJECTS AND SUMMARY OF THE INVENTION

Therefore, in view of the above, it is an object of the present invention to provide a combination voting booth/speaker's lectern which is simple in construction, easy to use, stable and strong and relatively inexpensive to manufacture.

Another object of the present invention is to provide a combination voting booth/speaker's lectern comprised of two sections of semi-rigid, foldable material which may be securely coupled together so as to form either a semi-enclosed structure for providing voter privacy or a generally flat, horizontal surface for use as a speaker's lectern which is securely supported by a stable, self-standing structure.

A further object of the present invention is to provide a small, lightweight and inexpensive voting booth which is self-contained, permits the voter to record his vote in seclusion, and is light enough to be easily folded and removed yet durable enough to be re-used.

The present invention contemplates a combination voting booth/speaker's lectern which includes a lower support element and an upper shelf element. The support and shelf elements each include a plurality of foldable sections permitting the support element to be formed into a three section array and the upper shelf element to be formed into four linked sections. The upper surface of the shelf element is enclosed on three sides by upstanding side walls formed by folding the shelf element along predetermined lines. The three sections of the support element are similarly formed by folding along three predetermined lines. The lower surface of the shelf element includes recessed linear portions which match the configuration of the folded lower support element and into which the lower support element is inserted for securely positioning the shelf element thereupon. The upstanding side walls of the shelf element may be folded along predetermined lines so as to assume orientations parallel with and immediately adjacent and above the shelf element. The present invention may then be utilized as a reinforced, self-supporting speaker's lectern.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference characters identify like elements throughout the various figures in which:

FIG. 1 is a perspective view of a combination voting booth/speaker's lectern in accordance with the present invention;

FIG. 2 is a partially folded side perspective view of the improved voting booth/speaker's lectern of the present invention;

FIG. 3 is a partial perspective view of a partially folded second embodiment of the voting booth/speaker's lectern wherein the side walls of the upper shelf element are foldably coupled to the back wall thereof;

FIG. 4 is an enlarged sectional view taken along line 4—4 of FIG. 1, showing the supporting engagement of the shelf element by the support element; and FIG. 5 is an exploded, perspective view of the voting booth/speaker's lectern showing the supporting engagement between the upper shelf element and the lower support element when assembled.

DETAILED DESCRIPTION OF THE PREFERRED EMBODIMENT

Referring to FIG. 1, there is shown a perspective view of a combination voting booth and speaker's lectern 10 in accordance with a preferred embodiment of the present invention. Voting booth/speaker's lectern 10 is comprised of an upper shelf element 12 and a lower, support element 14. The upper shelf element 12 and the lower, support element 14 are detachably coupled together in a manner to be described and each includes a plurality of articulated sections formed by folding a respective element along predetermined lines such as of perforations. In a preferred embodiment, the upper shelf and lower support elements 12, 14 are comprised of a corrugated cardboard composition, although any of the more common semi-rigid, workable structural materials could as easily be used herein.

In one embodiment the upper shelf element 12 includes a plurality of sections foldably coupled to a generally horizontal shelf 22. These foldable sections include a back wall 16 and side walls 18, 22. The back wall 16 and side walls 18, 20 are flexibly coupled to three lateral edges of the shelf 22 and in the voting booth configuration of the present invention are positioned in a generally vertical orientation when assembled and in position. The distal edge of the back wall 16 includes an edge panel 24 foldably coupled thereto. Edge panel 24 is particularly adapted for the folded configuration of the upper shelf element and will be described below with respect thereto.

The lower support element 14 is also comprised of a single piece of a semi-rigid structural material, such as corrugated cardboard. By bending the lower support element 14 along two, parallel, predetermined lines, which may be defined by a linear arrangement of a plurality of perforations, the lower support element may be divided into three, attached sections. These sections include a support element back wall 30 and two side walls 34, 36 flexibly coupled thereto. The lower edge portions of back wall 30 and side walls 34, 36 generally form a planar array which functions as a base for stably supporting the portable voting booth/lectern 10.

Referring to FIG. 2, there is shown the portable voting booth/lectern 10 of FIG. 1 wherein the upper shelf element 12 is shown in a partially folded configuration. From FIG. 2 it can be seen that the side walls 18, 20 pivotally coupled to the shelf 22 of the upper shelf element 12 may be folded downward so as to be positioned generally parallel to and in close proximity to the upper surface of shelf element 12. In FIG. 2, side wall 20 has been folded so as to be positioned in close proximity to, or in contact with, the upper surface of shelf 22, while side wall 18 is in a slightly upraised, partially folded position. With the side wall 18 in the fully down position, the back wall 16 of upper shelf element 12 may then be folded downward as shown by the arrow in FIG. 2 so as to assume a generally horizontal position, parallel with the planes of shelf 22 and side walls 18, 20. This results in a very compact configuration of the upper shelf element 12 which facilitates the portability and storage thereof. With back wall 16 in the folded position, the edge panel 24 thereof may be folded and inserted between the upper surface of shelf 22 and side walls 18, 20 so as to cover the adjacent lateral edges of side walls 18, 20 in providing protection therefor.

Referring to FIG. 3, there is shown a partial perspective view of a portable voting booth/lectern wherein a second embodiment of the upper shelf element is illustrated. In the embodiment of the upper shelf element 15 shown in FIG. 3, the side walls 34, 36 are pivotally coupled in a folding manner to back wall 16 rather than to the shelf 22 thereof as shown in the embodiment of FIGS. 1 and 2. FIG. 3 shows the upper shelf element 15 in a partially folded configuration wherein the side walls 34, 36 may be folded to a position in close proximity to the back wall of the upper shelf element and generally parallel to the plane thereof. With side walls 34, 36 thus folded, the shelf element's back wall 16 may then be folded downward so as to assume a position in close proximity and generally parallel to the plane of shelf 22. The edge panel of back panel 16 may then be folded so as to be positioned between the lower surface of the bottom side wall 36 and the upper surface of shelf 22. This configuration provides a smooth, continuous lateral surface of the upper shelf element 15 when used as a speaker's lectern. When utilized in this manner, the upper surface of back wall 16 provides a smooth, level and stable surface area for the lectern's user.

Referring to FIG. 4, there is shown an enlarged sectional view of the portable voting booth/lectern 10 taken along line 4—4 of FIG. 1 with the shelf element 12 in the folded position. From FIG. 4 it can be seen that the shelf 22 includes a plurality of generally horizontally oriented panels which provide a reinforced surface for use by a voter or speaker. In FIG. 4 side walls 18, 20 have been folded to a generally horizontal position and are positioned immediately beneath back wall 16 which is also shown in a folded position. Immediately subjacent side wall 20 is the upper surface panel 44 of the upper shelf element 12. Immediately subjacent upper surface panel 44 are sectioned panels 46, 48. As shown in FIG. 4, the space between adjacent sections of panels 46, 48 define a rear slot 52 running generally parallel to the back edge portion 58 of the shelf 22. When the upper shelf element 12 and the lower support element 14 are assembled, the upper portion of the back wall 30 of the support element is inserted within back slot 52 in an engaging manner. As shown in FIG. 4, the edge panel 24 of the back wall 16 is merely folded over the edges of side walls 18, 20 for their protection and is not inserted between the upper surface panel 44 and the side walls as previously described in another embodiment of the present invention.

Referring to FIG. 5, it can be seen that the lower surface of shelf element 12 also includes lateral slots 54, 56 adjacent respective lateral edges thereof which join with rear slot 52 in defining a three-sided, continuous slot in the lower surface of upper shelf element 12. The upper shelf element 22 and the lower support element 14 are assembled by inserting the respective upper edge portions of back wall 30 and lateral walls 26, 28 into rear slot 52 and lateral slots 56, 54, respectively. In this manner, the upper shelf element and the lower support element are coupled together in a semi-rigid manner to permit the lower support element 14 to stably support the upper shelf element 12. These two elements of the portable voting booth/lectern may be easily separated in facilitating the disassembly thereof. Upper shelf element 12 may then be folded as previously described and lower support element 14 may be folded along predetermined lines as shown in FIG. 5 so that lateral walls 26, 28 are generally parallel and in close proximity to back wall 30. The portable voting booth/lectern 10 of the present invention is then configured in two flat panels and may be easily carried and conveniently stored until next used.

In another embodiment, the upper edge of back wall 30 is provided with an extension portion 62 which is coupled in a flexible manner thereto. The upper edge of the extension portion 62 may be securely coupled in a conventional manner within the rear slot 52 of shelf element 12. Shelf element 12 then forms a single structural member with the lower support element 14 with the thus formed single unit foldable along line 64 in permitting the shelf element 12 to be positioned immediately adjacent and parallel to the folded lateral walls 26, 28 of the lower support element 14 for storage and/or shipping of the portable voting booth/lectern 10 of the present invention.

There has thus been shown a portable, foldable combination voting booth and speaker's lectern which provides a portable, lightweight, durable structure which may be easily set up or taken down. The structure is comprised of only two, separate components, each of which is foldable into a plurality of connected panels providing stable support for either a semi-enclosed voting booth or a flat surface for a speaker's lectern.

While particular embodiments of the present invention have been shown and described, it will be apparent to those skilled in the art that changes and modifications may be made therein without departing from the invention in its broader aspects. The aim of the appended claims, therefore, is to cover all such changes and modifications as fall within the true spirit and scope of the invention.

I claim:

1. A combination voting booth/speaker's lectern comprising:

a lower, generally flat, planar support member foldable into three flexible coupled sections including a back section and two side sections oriented generally vertically in a nonplanar configuration and including an upper edge portion and a lower edge portion, with said back section including an extension portion foldably coupled to said upper edge of said back section; and an upper, planar shelf member having upper and lower surfaces and foldable into a plurality of flexibly coupled sections including a generally horizontal bottom section and a plurality of sidewalls foldable into a first generally upright position for substantially enclosing the upper surface of said bottom section for use as a voting booth or a second generally horizontal position immediately adjacent the upper surface of said bottom section for use as a speaker's lectern, the lower surface of said shelf member including a three coupled linear groove therein for receiving the upper edge portion of said back and side sections of said support member and wherein said extension portion on said back section is fixedly positioned within and coupled to one of said coupled linear grooves in the lower surface of said shelf member whereby said shelf member and said support member form a single structural unit foldable along the union of said extension portion and the upper edge of said back section.

* * * * *

UNITED STATES PATENT AND TRADEMARK OFFICE

CERTIFICATE OF CORRECTION

PATENT NO. : 4,484,787

DATED : November 27, 1984

INVENTOR(S) : Richard J. Stephens

It is certified that error appears in the above—identified patent and that said Letters Patent is hereby corrected as shown below:

Column 6, line 7 delete "flexible" insert --flexibly--.

Signed and Sealed this

*Fourth* Day of *June 1985*

[SEAL]

*Attest:*

DONALD J. QUIGG

*Attesting Officer* *Acting Commissioner of Patents and Trademarks*